US010190456B2

(12) United States Patent
Takeuchi

(10) Patent No.: US 10,190,456 B2
(45) Date of Patent: Jan. 29, 2019

(54) OIL REMOVAL APPARATUS

(71) Applicant: TOYOTA JIDOSHA KABUSHIKI KAISHA, Toyota-shi, Aichi (JP)

(72) Inventor: Naoki Takeuchi, Susono (JP)

(73) Assignee: TOYOTA JIDOSHA KABUSHIKI KAISHA, Aichi, Toyota-shi (JP)

( * ) Notice: Subject to any disclaimer, the term of this patent is extended or adjusted under 35 U.S.C. 154(b) by 0 days.

(21) Appl. No.: 15/516,275

(22) PCT Filed: Sep. 30, 2015

(86) PCT No.: PCT/JP2015/004984
§ 371 (c)(1),
(2) Date: Mar. 31, 2017

(87) PCT Pub. No.: WO2016/051798
PCT Pub. Date: Apr. 7, 2016

(65) Prior Publication Data

US 2017/0306815 A1 Oct. 26, 2017

(30) Foreign Application Priority Data

Oct. 2, 2014 (JP) ..... 2014-203945

(51) Int. Cl.
*B03C 3/08* (2006.01)
*B03C 3/41* (2006.01)
(Continued)

(52) U.S. Cl.
CPC ..... *F01M 13/04* (2013.01); *B03C 3/08* (2013.01); *B03C 3/155* (2013.01); *B03C 3/41* (2013.01);
(Continued)

(58) Field of Classification Search
CPC ..... F01M 13/04; F01M 2013/0438; F01M 2013/0466; B03C 3/017; B03C 3/0175;
(Continued)

(56) References Cited

U.S. PATENT DOCUMENTS 3,406,669 A * 10/1968 Edwards ..... B03C 3/017 123/537
4,018,580 A * 4/1977 Burkholz ..... B01D 46/10 55/321
(Continued)

FOREIGN PATENT DOCUMENTS

CN 2542333 Y 4/2003
JP 59-127621 A 7/1984
(Continued)

OTHER PUBLICATIONS

Norikazu Namiki, et al., "Characteristics of Particles Generated from Conveyors and Development of a Particle Collection for Clean Elevators", Japan Association of Aerosol Science and Technology, 1999, pp. 338-347, vol. 14, No. 4.
(Continued)

*Primary Examiner* — Jason M Greene
(74) *Attorney, Agent, or Firm* — Sughrue Mion, PLLC

(57) ABSTRACT

An object of the present invention is to suppress conduction between an anode and a cathode caused by condensed water in an oil removal apparatus in which oil particles are trapped in a filter disposed between the anode and the cathode. A bipolar electrode having an anode and a cathode that extend in a flow direction of blow-by gas, and a filter formed from an insulator and disposed between the anode and the cathode of the bipolar electrode are housed in a case. Further, when the oil removal apparatus is installed in a vehicle, the bipolar electrode and the filter are disposed in the case so as to be arranged in a horizontal direction, and a space through which the blow-by gas flows is formed between a lower
(Continued)

inner wall surface of the case, and the bipolar electrode and filter.

6 Claims, 3 Drawing Sheets

(51) Int. Cl.
*B03C 3/47* (2006.01)
*F01N 3/01* (2006.01)
*B03C 3/155* (2006.01)
*F01M 13/04* (2006.01)

(52) U.S. Cl.
CPC ..... *B03C 3/47* (2013.01); *F01N 3/01* (2013.01); *B03C 2201/30* (2013.01); *F01M 13/0416* (2013.01); *F01M 2013/0438* (2013.01); *F01M 2013/0466* (2013.01)

(58) Field of Classification Search
CPC .. B03C 3/06; B03C 3/08; B03C 3/155; B03C 3/40; B03C 3/41; B03C 3/47; B03C 2201/30; B01D 45/02; F01N 3/01
See application file for complete search history.

(56) References Cited

U.S. PATENT DOCUMENTS 4,627,406 A * 12/1986 Namiki ..... F01M 13/04 123/572
5,243,950 A * 9/1993 Dalupan ..... F01M 13/04 123/536
5,557,923 A * 9/1996 Bolt ..... B03C 3/0175 55/466
6,235,089 B1 * 5/2001 Erdmannsdoerfer .. B01D 45/08 55/385.3
6,238,464 B1 * 5/2001 Dullien ..... B01D 45/02 55/304
2005/0224022 A1 10/2005 Heckel et al.
2005/0224023 A1 10/2005 Heckel et al.
2005/0237693 A1 10/2005 Heckel et al.
2012/0216674 A1 8/2012 Maus
2012/0251785 A1 * 10/2012 Ohira ..... C08G 77/448 428/156

FOREIGN PATENT DOCUMENTS

JP 2001-503323 A 3/2001
JP 2005-103357 * 4/2005 ..... C03C 3/00
JP 2005-103357 A 4/2005
JP 2005-334876 A 12/2005
JP 2011-047353 A 3/2011
JP 2012-096217 A 5/2012

OTHER PUBLICATIONS

Takahiro Kawamoto, et al., "Study on the removal mechanism of lubricant oil particles exhausted from air compressor (Second Report)—Effect of Micro Fiber Structure on Particles Removal Performance—", Proceedings for Academic Symposia of Society of Automotive Engineers of Japan, Inc. (JSAE), 2013, Document No. 20135865, No. 118-13.
International Search Report for PCT/JP2015/004984 dated Jan. 21, 2016 [PCT/ISA/210].
Written Opinion for PCT/JP2015/004984 dated Jan. 21, 2016 [PCT/ISA/210].

* cited by examiner

[Fig. 1]
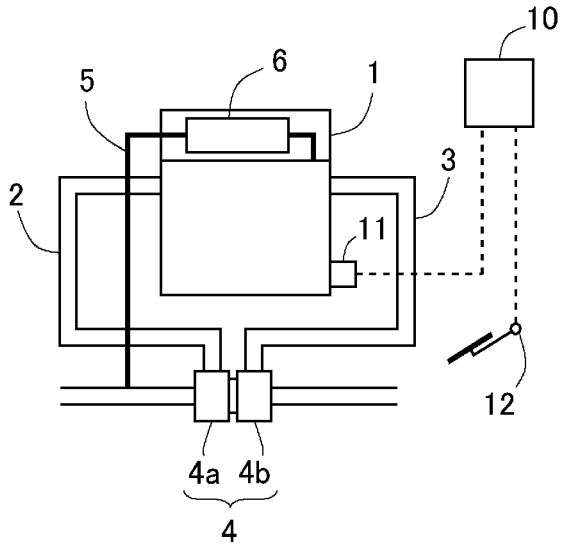
[Fig. 2]
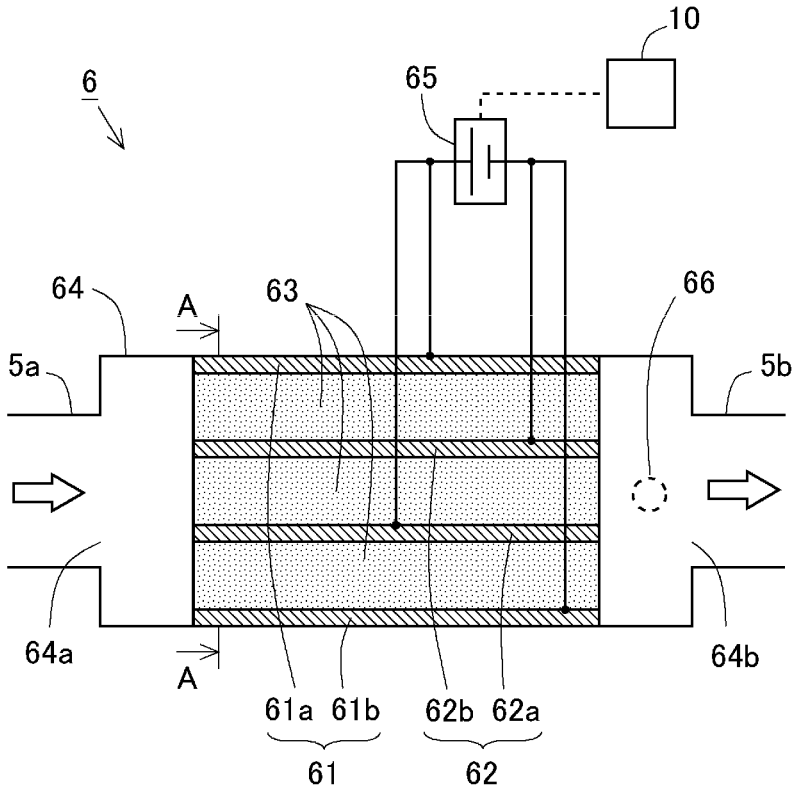

[Fig. 3]
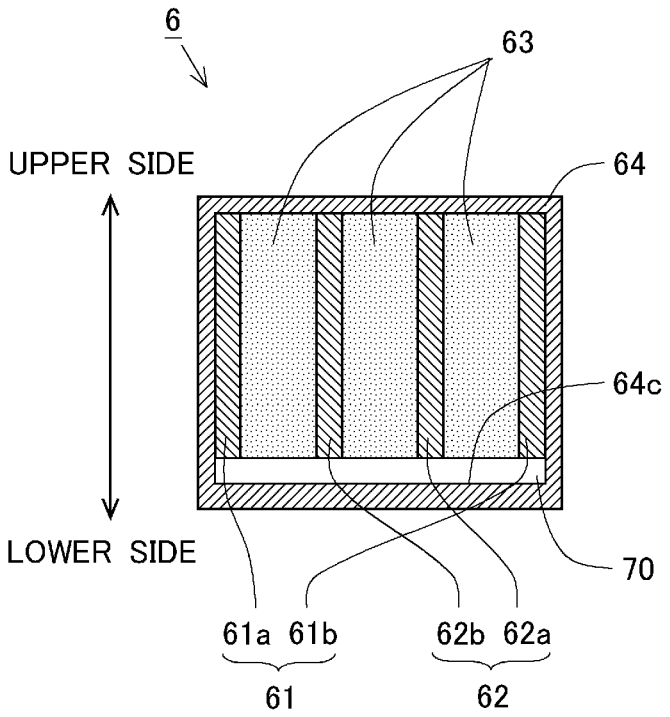
[Fig. 4]
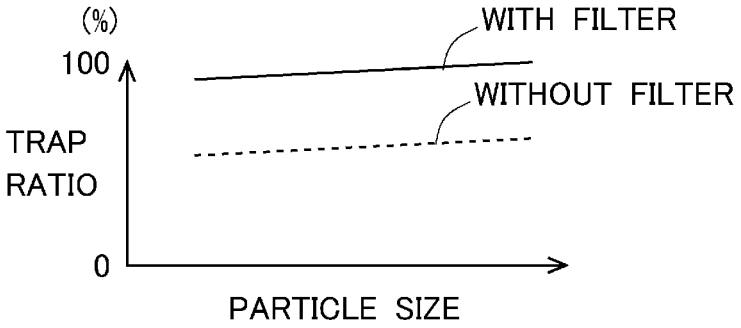

[Fig. 5]
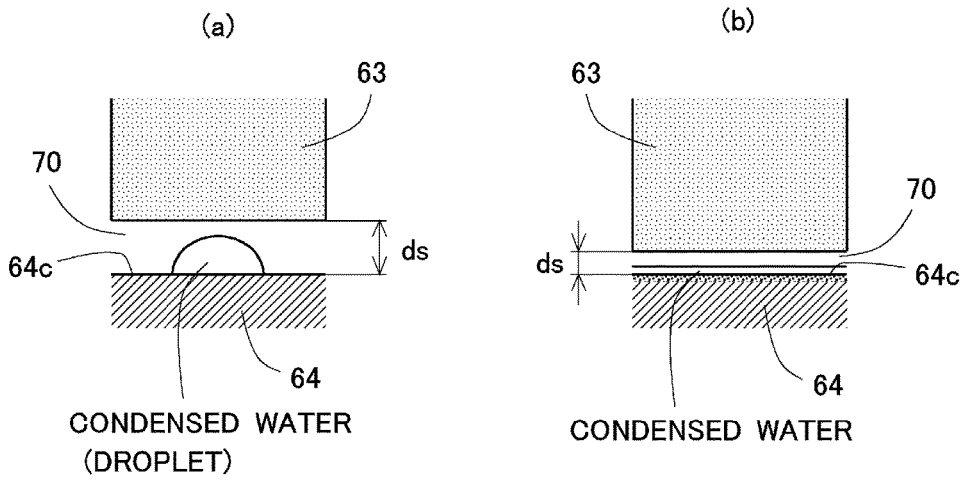

OIL REMOVAL APPARATUS

TECHNICAL FIELD

The present invention relates to an oil removal apparatus that removes oil particles (oil mist) contained in blow-by gas in an internal combustion engine.

BACKGROUND ART

In a conventional technique employed in an internal combustion engine, blow-by gas is recirculated to an intake system from a crank case through a blow-by gas passage. An oil removal apparatus that removes oil particles contained in the blow-by gas is provided in the blow-by gas passage. PTL 1, for example, discloses an electrostatic precipitator having a collector electrode that collects ionized oil mist within an electric field created by a pulse-driven high voltage corona discharge electrode.

Furthermore, NPL 1 discloses a microparticle removal unit used in a clean elevator of a clean room. This removal unit mainly removes microparticles believed to originate from oil using a dielectric filter method. The removal unit is structured such that a nonwoven fabric serving as a dielectric fiber layer is filled between an anode and a cathode of a parallel plate electrode. Dielectric polarization is generated in the nonwoven fabric by applying a voltage to the electrodes, and microparticles are collected in the nonwoven fabric using a dielectric polarization force that acts between the fibers and the microparticles in addition to Coulomb force acting on charged particles.

CITATION LIST

Patent Literature

[PTL 1]
Japanese Patent Application Laid-Open No. 2005-334876

Non Patent Literature

[NPL 1]
Japan Association of Aerosol Science and Technology vol. 14 No. 4, 338-347 (1999)

SUMMARY OF INVENTION

Technical Problem

When a method using dielectric polarization of a filter is employed in an oil removal apparatus that removes oil particles contained in blow-by gas flowing through a blow-by gas passage of an internal combustion engine, the oil removal apparatus is configured such that a filter formed from an insulator is disposed between an anode and a cathode extending in a flow direction of the blow-by gas of a bipolar electrode. With this configuration, dielectric polarization is generated in the filter by applying a voltage to the bipolar electrode such that dielectric polarization force acts on the oil particles flowing through the filter. Further, many of the oil particles contained in the blow-by gas are charged, and therefore, when a voltage is applied to the bipolar electrode, Coulomb force acts on the charged oil particles in addition to the dielectric polarization force. As a result, the oil particles are trapped in the filter and thereby removed from the blow-by gas.

Here, the blow-by gas contains moisture, and therefore condensed water may be generated in the oil removal apparatus when the moisture in the blow-by gas condenses. When condensed water is generated in the oil removal apparatus configured as described above, the condensed water may spread through the filter such that conduction occurs between the anode and the cathode. When conduction occurs between the anode and the cathode due to the condensed water, a power consumption may increase.

The present invention has been designed in consideration of the problem described above, and an object thereof is to suppress conduction between an anode and a cathode of a bipolar electrode caused by condensed water in an oil removal apparatus in which oil particles are trapped in a filter disposed between the anode and the cathode.

Solution to Problem

According to the present invention, when the oil removal apparatus is installed in a vehicle, the bipolar electrode and the filter are disposed in a case so as to be arranged in a horizontal direction. Further, a space through which blow-by gas flows is formed in the case between a lower inner wall surface of the case, and the bipolar electrode and filter.

More specifically, an oil removal apparatus according to the present invention is capable of removing oil particles contained in blow-by gas that flows through a blow-by gas passage of an internal combustion engine, and includes:

a bipolar electrode having an anode and a cathode that extend in a flow direction of the blow-by gas;

a filter formed from an insulator and disposed between the anode and the cathode of the bipolar electrode;

a case housing the bipolar electrode and the filter; and a voltage applicator configured to supply a voltage to the bipolar electrode, wherein, when the oil removal apparatus is installed in a vehicle, the bipolar electrode and the filter are disposed in the case so as to be arranged in a horizontal direction, and a space through which the blow-by gas flows is formed between a lower inner wall surface of the case, and the bipolar electrode and filter.

Condensed water generated in the filter moves downward in a gravitational direction. Here, when the oil removal apparatus according to the present invention is installed in a vehicle, the bipolar electrode and the filter are disposed in the case so as to be arranged in the horizontal direction. Accordingly, the condensed water generated in the filter moves toward a lower end portion of the filter. The space through which the blow-by gas flows is formed between the lower inner wall surface of the case, and the bipolar electrode and filter, and therefore the condensed water forms droplets after reaching the lower end portion of the filter, whereupon the droplets drip down through the space onto the lower inner wall surface of the case.

According to the present invention, therefore, a situation in which the condensed water passes through the filter so as to connect the anode and the cathode of the bipolar electrode can be suppressed. Moreover, the space between the lower inner wall surface of the case, and the bipolar electrode and filter functions as an insulating layer. Hence, according to the present invention, conduction between the anode and the cathode due to the condensed water can be suppressed.

In the present invention, hydrophilic treatment may be implemented on the lower inner wall surface of the case. According to this configuration, the droplets of condensed water dripping onto the lower inner wall surface of the case are less likely to remain in droplet form on the lower inner wall surface, and are therefore more likely to spread thinly over the surface of the lower inner wall surface. The condensed water dripping onto the lower inner wall surface of the case is therefore unlikely to contact the filter and the bipolar electrode. Accordingly, conduction between the anode and the cathode due to the condensed water can be suppressed. Moreover, conduction between the anode and the cathode due to the condensed water can be suppressed even when a height of the space between the lower inner wall surface of the case, and the bipolar electrode and filter is reduced, and by reducing the height of the space, a reduction in an oil particle trap ratio (a ratio of an amount of trapped oil particles relative to an amount of inflowing oil particles) of the oil removal apparatus can be suppressed.

Furthermore, in the present invention, the filter may be a fibrous filter, and hydrophobic treatment may be implemented on a surface of fiber forming the fibrous filter. In this case, the condensed water is more likely to form droplets on the surface of the fiber forming the filter, and less likely to infiltrate the fiber. Accordingly, the condensed water is less likely to spread through the filter. Furthermore, the condensed water droplets are more likely to drip (move) downward in the gravitational direction. According to this configuration, therefore, a connection by the condensed water is less likely to be formed in the filter. As a result, conduction between the anode and the cathode due to the condensed water can be suppressed even more effectively.

Advantageous Effects of Invention

According to the present invention, in an oil removal apparatus that traps oil particles in a filter disposed between an anode and a cathode of a bipolar electrode, conduction between the anode and the cathode caused by condensed water can be suppressed.

BRIEF DESCRIPTION OF DRAWINGS

FIG. 1 is a schematic view showing a configuration of an internal combustion engine and an intake/exhaust system thereof according to an embodiment.

FIG. 2 is a schematic view showing a configuration of an oil removal apparatus according to a first embodiment.

FIG. 3 is a view showing an A-A cross-section of the oil removal apparatus shown in FIG. 2.

FIG. 4 is a view showing an oil particle trap ratio of the oil removal apparatus.

FIG. 5 is an image diagram showing condensed water on a lower inner wall surface of a case according to the first embodiment and a modified example thereof.

DESCRIPTION OF EMBODIMENTS

Specific embodiments of the present invention will be described below on the basis of the drawings. Unless specified otherwise, the technical scope of the present invention is not limited to the dimensions, materials, shapes, relative arrangements, and so on of constituent components described in the embodiments.

First Embodiment

An embodiment of a case in which the oil removal apparatus according to the present invention is applied to a diesel engine will be described. Note that the oil removal apparatus according to the present invention is not limited to a diesel engine, and may be employed in another engine that uses oil (lubricating oil), such as a gasoline engine.

<Configuration of Internal Combustion Engine and Intake/Exhaust System Thereof>

FIG. 1 is a schematic view showing a configuration of the internal combustion engine and an intake/exhaust system thereof according to this embodiment. An internal combustion engine 1 is a diesel engine installed in a vehicle. An intake passage 2 and an exhaust passage 3 are connected to the internal combustion engine 1. A compressor 4*a* of a turbocharger 4 is provided midway in the intake passage 2. A turbine 4*b* of the turbocharger 4 is provided midway in the exhaust passage 3.

An electronic control unit (ECU) 10 is provided alongside the internal combustion engine 1. A crank position sensor 11 and an accelerator operation amount sensor 12 are electrically connected to the ECU 10. The crank position sensor 11 detects a rotation position of an output shaft (a crankshaft) of the internal combustion engine 1. The accelerator operation amount sensor 12 detects an accelerator operation amount of the vehicle in which the internal combustion engine 1 is installed. Output signals from the respective sensors are input into the ECU 10. The ECU 10 calculates an engine load of the internal combustion engine 1 on the basis of an output value from the accelerator operation amount sensor 12. Further, the ECU 10 calculates an engine rotation speed of the internal combustion engine 1 on the basis of an output value from the crank position sensor 11.

The internal combustion engine 1 is further provided with a blow-by gas passage 5. One end of the blow-by gas passage 5 communicates with a crank case of the internal combustion engine 1. The blow-by gas passage 5 extends through a cylinder head cover of the internal combustion engine 1 such that the other end thereof is connected to the intake passage 2 on an upstream side of the compressor 4*a*. Blow-by gas is recirculated to the intake passage 2 from the crank case through the blow-by gas passage 5.

The blow-by gas contains oil particles (oil mist) generated when oil is scattered in the internal combustion engine 1. Hence, an oil removal apparatus 6 is provided in the blow-by gas passage 5 within the cylinder head of the internal combustion engine 1 in order to remove the oil particles contained in the blow-by gas.

<Configuration of Oil Removal Apparatus>

Here, a configuration of the oil removal apparatus according to this embodiment will be described briefly on the basis of FIGS. 2 and 3. FIG. 2 is a pattern diagram showing the oil removal apparatus 6 from above in a gravitational direction. Note that in FIG. 2, black-outlined arrows indicate a flow of the blow-by gas. FIG. 3 is a view showing an A-A cross-section of the oil removal apparatus 6 shown in FIG. 2. Note that upper and lower sides in FIG. 3 correspond to upper and lower sides in the gravitational direction when the oil removal apparatus 6 is installed in a vehicle.

A first bipolar electrode 61, a second bipolar electrode 62, and a filter 63 are provided in a case 64 of the oil removal apparatus 6. An upstream side (crank case side) blow-by gas passage 5*a* is connected to a gas inlet 64*a* of the case 64. The blow-by gas flows into the case 64 from the blow-by gas passage 5*a* through the gas inlet 64*a*. A downstream side (intake passage side) blow-by gas passage 5*b* is connected to a gas outlet 64*b* of the case 64. The blow-by gas flows out of the case 64 into the blow-by gas passage 5*b* through the gas outlet 64*b*.

The first bipolar electrode 61 is a parallel plate electrode including an anode 61*a* and a cathode 61*b* that extend in a flow direction of the blow-by gas. The second bipolar electrode 62 is a parallel plate electrode including an anode 62*a* and a cathode 62*b* that extend in the flow direction of the blow-by gas, and is provided between the anode 61*a* and the cathode 61*b* of the first bipolar electrode 61. Further, when the oil removal apparatus 6 is installed in the vehicle, the anode 61*a* and cathode 61*b* of the first bipolar electrode 61, and the anode 62*a* and cathode 62*b* of the second bipolar electrode 62 are disposed in the horizontal direction. Furthermore, the anode 62*a* of the second bipolar electrode 62 is positioned on the side of the cathode 61*b* of the first bipolar electrode 61, while the cathode 62*b* of the second bipolar electrode 62 is positioned on the side of the anode 61*a* of the first bipolar electrode 61. In other words, the respective bipolar electrodes are disposed such that the anode 62*a* and the cathode 62*b* of the second bipolar electrode 62 face each other, the anode 61*a* of the first bipolar electrode 61 and the cathode 62*b* of the second bipolar electrode 62 face each other, and the cathode 61*b* of the first bipolar electrode 61 and the anode 62*a* of the second bipolar electrode 62 face each other.

The filter 63 is provided between the anode 61*a* of the first bipolar electrode 61 and the cathode 62*b* of the second bipolar electrode 62, between the cathode 62*b* of the second bipolar electrode 62 and the anode 62*a* of the second bipolar electrode 62, and between the anode 62*a* of the second bipolar electrode 62 and the cathode 61*b* of the first bipolar electrode 61. In other words, the respective anodes and cathodes 61*a*, 61*b*, 62*a*, 62*b* and the filter 63 are disposed in the case 64 so as to be arranged in the horizontal direction. The filter 63 is a fibrous filter formed from insulating fiber such as polyethylene terephthalate (PET) or glass fiber. Further, to reduce pressure loss, a filter having a small filling factor (a filling factor of approximately 0.014 (1.4%), for example) is employed as the filter 63. Note that the filter 63 does not necessarily have to be provided over an entire region between the bipolar electrodes from an upstream end to a downstream end of the bipolar electrodes. Moreover, a space 70 through which the blow-by gas flows is formed between a lower inner wall surface 64*c* of the case 64, and the respective anodes and cathodes 61*a*, 61*b*, 62*a*, 62*b* and filter 63.

Furthermore, a drain passage 66 is connected to a lower side of the case 64 on a downstream side of the part in which the bipolar electrodes 61, 62 and the filters 63 are disposed. The drain passage 66 communicates with the interior of the cylinder head of the internal combustion engine 1. Recovered oil trapped by the filters 63 is returned to the internal combustion engine 1 through the drain passage 66. To enable the recovered oil to flow into the drain passage 66 more easily, the oil removal apparatus 6 may be disposed in the cylinder head of the internal combustion engine 1 at an incline so that the gas outlet 64*b* of the case 64 is positioned below the gas inlet 64*a*. Further, a lower wall surface of the case 64 may be formed as an inclined surface such that the gas outlet 64*b* side of the case 64 is positioned below the gas inlet 64*a* side. Moreover, a guide passage for guiding the recovered oil to the drain passage 66 may be provided in the lower wall surface of the case 64.

The respective bipolar electrodes 61, 62 are electrically connected to a power supply 65 that applies a voltage to the bipolar electrodes 61, 62. The power supply 65 is electrically connected to the ECU 10. Voltage application to the respective bipolar electrodes 61, 62 is controlled by the ECU 10.

Note that in the oil removal apparatus according to this embodiment, a configuration employing two bipolar electrode sets, namely the first and second bipolar electrodes 61, 62, is employed. However, the oil removal apparatus according to the present invention is not limited to this electrode configuration, and a configuration having a single bipolar electrode set or a configuration having three or more bipolar electrode sets may be employed instead.

<Mechanism for Trapping Oil Particles>

A mechanism by which the oil particles contained in the blow-by gas are trapped in the oil removal apparatus according to this embodiment will now be described. In the oil removal apparatus 6, as described above, the filling factor of the filter 63 is small, and therefore, when no voltage is applied to the bipolar electrodes 61, 62, substantially none of the oil particles contained in the blow-by gas are trapped in the filters 63. When a voltage is applied to the bipolar electrodes 61, 62, however, dielectric polarization force and Coulomb force act on the oil particles, and as a result, the oil particles are trapped in the filters 63.

FIG. 4 is a view showing an oil particle trap ratio of the oil removal apparatus. A solid line in FIG. 4 shows the oil particle trap ratio when a voltage is applied to an anode and a cathode of an oil removal apparatus configured such that a filter formed from an insulator and having a small filling factor, as in this embodiment, is provided between the anode and the cathode. Further, a dotted line in FIG. 4 shows the oil particle trap ratio when a voltage is applied to an anode and a cathode of an oil removal apparatus configured such that a filter is not provided between the anode and the cathode. The solid line and the dotted line in FIG. 4 show the trap ratio in cases where an identical predetermined voltage is applied to the anodes and cathodes of the two oil removal apparatuses. Note that in FIG. 4, the ordinate shows the oil particle trap ratio of the oil removal apparatus, and the abscissa shows a particle size of the oil particles. Furthermore, numerical values of the oil particle trap ratio in FIG. 4 are numerical values obtained in a case where a distance between the anode and the cathode is set at a specific distance, and when the filter is provided (the solid line), the filling factor of the filter is set at a specific filling factor. In other words, the numerical values of the oil particle trap ratio shown in FIG. 4 are merely examples, and these numerical values vary in accordance with the distance between the anode and the cathode.

As shown by the dotted line in FIG. 4, even with the configuration in which a filter is not provided between the anode and the cathode, when the predetermined voltage is applied to the electrodes, an oil particle trap ratio of at least 50% is obtained, regardless of the particle size of the oil particles. In other words, a part of the oil particles contained in the blow-by gas is trapped by the electrodes even when a filter is not provided between the anode and the cathode. The reason for this is that when oil in respective operating parts of the internal combustion engine turns into mist, many of the oil particles are charged, and therefore many of the oil particles in the blow-by gas are charged. Hence, when a voltage is applied to the bipolar electrodes in the oil removal apparatus, Coulomb force acts on the charged oil particles.

Further, as shown by the solid line in FIG. 4, with the configuration in which the filter is provided between the anode and the cathode, the oil particle trap ratio of the oil removal apparatus improves in comparison with the configuration in which a filter is not provided between the anode and the cathode such that a trap ratio of approximately 90% is obtained. The reason for this is that when a voltage is applied to the bipolar electrodes, dielectric polarization occurs in the filter formed from an insulator (a dielectric), and therefore dielectric polarization force acts on the oil particles contained in the blow-by gas in addition to the Coulomb force, with the result that the oil particles are trapped in the filter. The Coulomb force acts only on the charged oil particles, whereas the dielectric polarization force also acts between uncharged oil particles and the filter. Therefore, not only the charged oil particles but also the uncharged oil particles are trapped in the filter. Furthermore, the force acting on the uncharged oil particles increases by applying the dielectric polarization force to the uncharged oil particles in addition to the Coulomb force. Hence, with the configuration in which the filter is provided between the anode and the cathode, even though the filter has such a small filling factor that substantially no oil particles are trapped therein when no voltage is applied to the electrodes, the oil particle trap ratio of the oil removal apparatus is higher than with the configuration in which the filter is not provided between the anode and the cathode.

<Countermeasures Against Condensed Water>

The blow-by gas contains moisture. Hence, the moisture in the blow-by gas may condense inside the oil removal apparatus 6 so as to generate condensed water. When the condensed water spreads through the filter 63, the condensed water may cause conduction to occur between the anode and the cathode of the bipolar electrode, which are provided so as to face each other on either side of the filter 63, and as a result, power consumption may increase. In this embodiment, therefore, conduction between the anode and the cathode caused by condensed water is suppressed by disposing the respective anodes and cathodes 61*a*, 61*b*, 62*a*, 62*b* and the filter 63 in the case 64 so as to be arranged in the horizontal direction, and forming the space 70 between the lower inner wall surface 64*c* of the case 64, and the respective anodes and cathodes 61*a*, 61*b*, 62*a*, 62*b* and filter 63.

The condensed water generated in the filter 63 moves downward in the gravitational direction. Therefore, the condensed water generated in the filter 63 of the oil removal apparatus 6, in which the respective anodes and cathodes 61*a*, 61*b*, 62*a*, 62*b* and the filter 63 are disposed in the case 64 so as to be arranged in the horizontal direction, moves toward a lower end portion of the filter 63. Since the space 70 is formed between the lower end portion of the filter 63 and the lower inner wall surface 64*c* of the case 64, the condensed water forms droplets after reaching the lower end portion of the filter 63, whereupon the droplets drip down through the space 70 onto the lower inner wall surface 64*c* of the case 64.

Hence, with the configuration according to this embodiment, the condensed water is unlikely to spread through the filter 63 to the anode and the cathode sandwiching the filter 63, and as a result, a situation in which the condensed water passes through the filter 63 so as to connect the anode and the cathode of the bipolar electrode can be suppressed. Moreover, the space 70 has a predetermined height, and therefore the condensed water that drips onto the lower inner wall surface 64*c* of the case 64 does not contact the lower end portion of the filter 63 and lower end portions of the respective anodes and cathodes 61*a*, 61*b*, 62*a*, 62*b*. Furthermore, the space 70 through which the blow-by gas flows functions as an insulating layer. According to this configuration, therefore, conduction between the anode and the cathode due to the condensed water can be suppressed.

Note that in this embodiment, the condensed water that drips onto the lower inner wall surface 64*c* of the case 64 flows into the drain passage 66 together with the oil, and is returned to the internal combustion engine 1 through the drain passage 66.

First Modified Example

In this embodiment, hydrophilic treatment may be implemented on the lower inner wall surface 64*c* of the case 64. Processing for coating the surface of the bipolar electrode with a substance containing a silanol group as a functional group may be cited as an example of hydrophilic treatment.

FIG. 5 is an image diagram showing condensed water on the lower inner wall surface 64*c* of the case 64. FIG. 5(*a*) shows condensed water when hydrophilic treatment is not implemented on the lower inner wall surface 64*c*, and FIG. 5(*b*) shows condensed water when hydrophilic treatment is implemented on the lower inner wall surface 64*c*. When hydrophilic treatment is not implemented on the lower inner wall surface 64*c* of the case 64, as shown in FIG. 5(*a*), the droplets of condensed water dripping onto the lower inner wall surface 64*c* are more likely to remain in droplet form on the lower inner wall surface 64*c*. When the droplets of condensed water on the lower inner wall surface 64*c* contact the lower end portion of the filter 63 or the lower end portions of the anode or cathode, conduction may occur between the anode and the cathode via the condensed water on the lower inner wall surface 64*c*. Therefore, to suppress conduction between the anode and the cathode due to the condensed water, a height ds of the space 70 must be made greater than a height of the droplets of condensed water existing on the lower inner wall surface 64*c* of the case 64. As the height ds of the space 70 is increased, however, a sectional area of the filter 63 between the anode and the cathode in a vertical direction decreases relative to a sectional area thereof in the flow direction of the blow-by gas, and as a result, the oil particle trap ratio of the oil removal apparatus 6 decreases.

When, on the other hand, hydrophilic treatment is implemented on the lower inner wall surface 64*c* of the case 64, as shown in FIG. 5(*b*), the droplets of condensed water dripping onto the lower inner wall surface 64*c* are less likely to remain in droplet form on the lower inner wall surface 64*c*, and are therefore more likely to spread thinly over the surface of the lower inner wall surface 64*c*. The condensed water dripping onto the lower inner wall surface 64*c* of the case 64 is therefore unlikely to contact the lower end portions of the filter 63 and the anode and cathode. Accordingly, conduction between the anode and the cathode due to the condensed water can be suppressed more effectively. Moreover, conduction between the anode and the cathode due to the condensed water can be suppressed even when the height ds of the space 70 is reduced, and by reducing the height ds of the space 70, a reduction in the oil particle trap ratio of the oil removal apparatus 6 can be suppressed.

Second Modified Example

Further, hydrophobic treatment may be implemented on the surface of the fiber forming the filter 63. Processing for coating the surface of the fiber with a substance containing a saturated fluoroalkyl group, an alkylsilyl group, a fluorosilyl group, or a long chain alkyl group as a functional group may be cited as an example of hydrophobic treatment. In this case, the condensed water is more likely to form droplets on the surface of the fiber forming the filter 63 and less likely to infiltrate the fiber. Accordingly, the condensed water is less likely to spread through the filter 63. Furthermore, the condensed water droplets are more likely to drip (move) downward in the gravitational direction. Hence, by implementing hydrophobic treatment on the surface of the fiber forming the filter 63, a connection by the condensed water is less likely to be formed in the filter 63. As a result, conduction between the anode and the cathode due to the condensed water can be suppressed even more effectively.

REFERENCE SIGNS LIST

1 internal combustion engine
5 blow-by gas passage
6 oil removal apparatus
61, 62 bipolar electrode
61*a*, 61*b* anode
62*a*, 62*b* cathode
63 filter
64 case
64*c* lower inner wall surface
65 power supply
66 drain passage
70 space
10 ECU

The invention claimed is:

1. An oil removal apparatus that is capable of removing oil particles contained in blow-by gas flowing through a blow-by gas passage of an internal combustion engine, comprising:

a bipolar electrode having an anode and a cathode that extend in a flow direction of said blow-by gas;

a filter formed from an insulator and disposed between said anode and said cathode of said bipolar electrode, wherein in said filter dielectric polarization occurs when a voltage is applied to said bipolar electrode and said filter traps the oil particles;

a case housing said bipolar electrode and said filter; and a voltage applicator configured to supply a voltage to said bipolar electrode, wherein, when said oil removal apparatus is installed in a static vehicle, said bipolar electrode and said filter are stacked in said case so as to be arranged in a horizontal direction, and said oil removal apparatus is constructed so that said blow-by gas flows in the horizontal direction along said bipolar electrode, and a space through which said blow-by gas flows is formed between a lower inner wall surface of said case, and said bipolar electrode and filter.

2. An oil removal apparatus that is capable of removing oil particles contained in blow-by gas flowing through a blow-by gas passage of an internal combustion engine, comprising:

a bipolar electrode having an anode and a cathode that extend in a flow direction of said blow-by gas;

a filter formed from an insulator and disposed between said anode and said cathode of said bipolar electrode;

a case housing said bipolar electrode and said filter; and a voltage applicator configured to supply a voltage to said bipolar electrode, wherein, when said oil removal apparatus is installed in a static vehicle, said bipolar electrode and said filter are disposed in said case so as to be arranged in a horizontal direction, and a space through which said blow-by gas flows is formed between a lower inner wall surface of said case, and said bipolar electrode and filter, and hydrophilic treatment is implemented on said lower inner wall surface of said case.

3. The oil removal apparatus according to claim 1, wherein said filter is a fibrous filter, and hydrophobic treatment is implemented on a surface of fiber forming said fibrous filter.

4. The oil removal apparatus according to claim 2, wherein said filter is a fibrous filter, and hydrophobic treatment is implemented on a surface of fiber forming said fibrous filter.

5. The oil removal apparatus according to claim 1, wherein the filter is configured to permit condensed water, that is generated in the filter, to move downward in a gravitational direction perpendicular to the horizontal direction and collect on said lower inner wall surface of said case.

6. The oil removal apparatus according to claim 2, wherein the filter is configured to permit condensed water, that is generated in the filter, to move downward in a gravitational direction perpendicular to the horizontal direction and collect on said lower inner wall surface of said case on which the hydrophilic treatment is implemented.

* * * * *